US007757616B2

(12) United States Patent
Cohen

(10) Patent No.: US 7,757,616 B2
(45) Date of Patent: Jul. 20, 2010

(54) COLLAPSIBLE CAMPING KITCHEN TABLE

(76) Inventor: Warren Cohen, 10981 Decatur Rd., Philadelphia, PA (US) 19154

( * ) Notice: Subject to any disclaimer, the term of this patent is extended or adjusted under 35 U.S.C. 154(b) by 334 days.

(21) Appl. No.: 11/305,627

(22) Filed: Dec. 19, 2005

(65) Prior Publication Data

US 2007/0137530 A1 Jun. 21, 2007

(51) Int. Cl.
*A47B 3/00* (2006.01)

(52) U.S. Cl. ..... 108/132; 312/228

(58) Field of Classification Search ..... 108/33, 108/35, 38, 132, 115, 129, 28, 29; 297/17, 297/158.5, 158.4; 312/240, 241, 236
See application file for complete search history.

(56) References Cited

U.S. PATENT DOCUMENTS 1,366,910 A * 2/1921 Hegrat ..... 4/630
2,109,869 A * 3/1938 Ross ..... 297/143
2,140,685 A * 12/1938 Baxter ..... 108/119
3,915,529 A * 10/1975 Bernier ..... 312/237
5,139,308 A * 8/1992 Ziman ..... 297/188.06
6,123,209 A * 9/2000 Tseng ..... 211/186
6,443,521 B1 * 9/2002 Nye et al. ..... 297/158.4
2002/0078861 A1 * 6/2002 Davis ..... 108/14
2004/0140740 A1 * 7/2004 Gauss ..... 312/140.2

* cited by examiner

*Primary Examiner*—Darnell M Jayne
*Assistant Examiner*—Matthew W Ing
(74) *Attorney, Agent, or Firm*—LaMorte & Associates

(57) ABSTRACT

A plurality of folding tables that pack and store together as a single unit. The plurality includes a primary table. The primary table preferably includes a collapsible washbasin and a rack of shelves for storing provisions near the washbasin. Smaller secondary tables are also provided that set up separately from the primary table. The primary table, the secondary table and the rack of shelves are all collapsible. When these components are in their collapsed configurations, they can be interconnected. This produces a single compact unit for transportation that holds the primary table, the secondary table, the rack of shelves and other complementary objects.

12 Claims, 3 Drawing Sheets

COLLAPSIBLE CAMPING KITCHEN TABLE

BACKGROUND OF THE INVENTION

1. Field of the Invention

In general, the present invention relates to folding tables. More particularly, the present invention relates to folding tables that contain wash stations and can serve as part of a portable kitchen.

2. Prior Art Description

When people camp, tailgate or otherwise cook outside away from their homes, most of the dishes and utensils used to cook and eat the food are disposable. The use of disposable dishes, cups and utensils are preferred because they can be thrown away. Such objects do not need to be washed or carried any farther than the nearest trashcan. If non-disposable objects are used, the non-disposable objects must be either washed or stored and carried home to be washed.

A problem occurs when a person goes camping for a prolonged period of time. Inevitably, certain nondisposable objects, such as pots, pans, spatulas, coffee pots and the like must be cleaned in order to be kept sanitary. In order to clean such objects when camping, cleaning materials must be brought on the camping trip. Cleaning materials, such as soap and sponges, are easily carried. What is more difficult to carry is the facilities needed to hold, wash, rinse and dry the objects being washed. Campers therefore improvise and pack folding tables, water basins and drying racks that can be configured into a makeshift kitchen. Tables, basins and the like, however, take up space. Thus, only minimal amounts of such objects are taken on a camping trip, if they are taken at all. The result is that many campers use a camping kitchen that is small, crowded and difficult to use.

The prior art record is replete with various types of folding tables. Typically, a folding table has legs that fold flat under the tabletop. The tabletop itself may also fold in half in order to save space. Since folding tables are designed to be as compact and lightweight as possible, there is little excess space contained within the folding table once it is folded closed. Therefore, there is no room in the structure of a standard folding table to hold secondary objects, such as water basins. As a result, any camper that is looking to create a camping kitchen must purchase and pack multiple objects. Washbasins are purchased to hold water for washing. A folding table is purchased to support the washbasins. Complementary objects, such as drying racks, storage racks for food, soap and the like are then purchased. All these separate objects must then be packed and transported to the camp site.

Portable kitchen sets, typically referred to as mess sets, do exist and are used extensively by the army and other such military organizations. Such kitchen sets do contain washing facilities, a variety of racks and storage facilities that are collapsible and storable. However, military kitchen sets are designed to support a large number of men. The military kitchen sets, although portable, are large and pack into large heavy crates that are intended to be transported from site to site by trucks. Such military kitchen sets are therefore not practical for campers who need kitchen facilities for only one family or a few campers.

A need therefore exists for a portable camp kitchen that is compact, lightweight, inexpensive and provides useable facilities to prepare, store, wash and dry equipment and provisions. This need is met by the present invention as described and claimed below.

SUMMARY OF THE INVENTION

The present invention is an assembly that includes a plurality of folding tables that pack and store together as a single unit. The assembly includes a primary table. The primary table preferably includes a collapsible washbasin and a rack of shelves for storing provisions near the washbasin. Smaller secondary tables are also provided that set up separately from the primary table. The primary table, the secondary table and the rack of shelves are all collapsible. When these components are in their collapsed configurations, they can be interconnected. This produces a single compact unit for transportation that holds the primary table, the secondary table, the rack of shelves and other complementary objects.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention assembly can be used for many proposes, such as a portable gardener's station, or as a portable first aid station, the present invention is particularly well suited for use as a portable camping kitchen station. Accordingly, the exemplary embodiment of the present invention that is described is configured as a portable kitchen station in order to set forth the best mode of use contemplated for the invention. However, it will be understood that the manner in which the present invention assembly is used is secondary. Rather, it is the structure of the assembly for which patent protection is sought.

Figure 1:
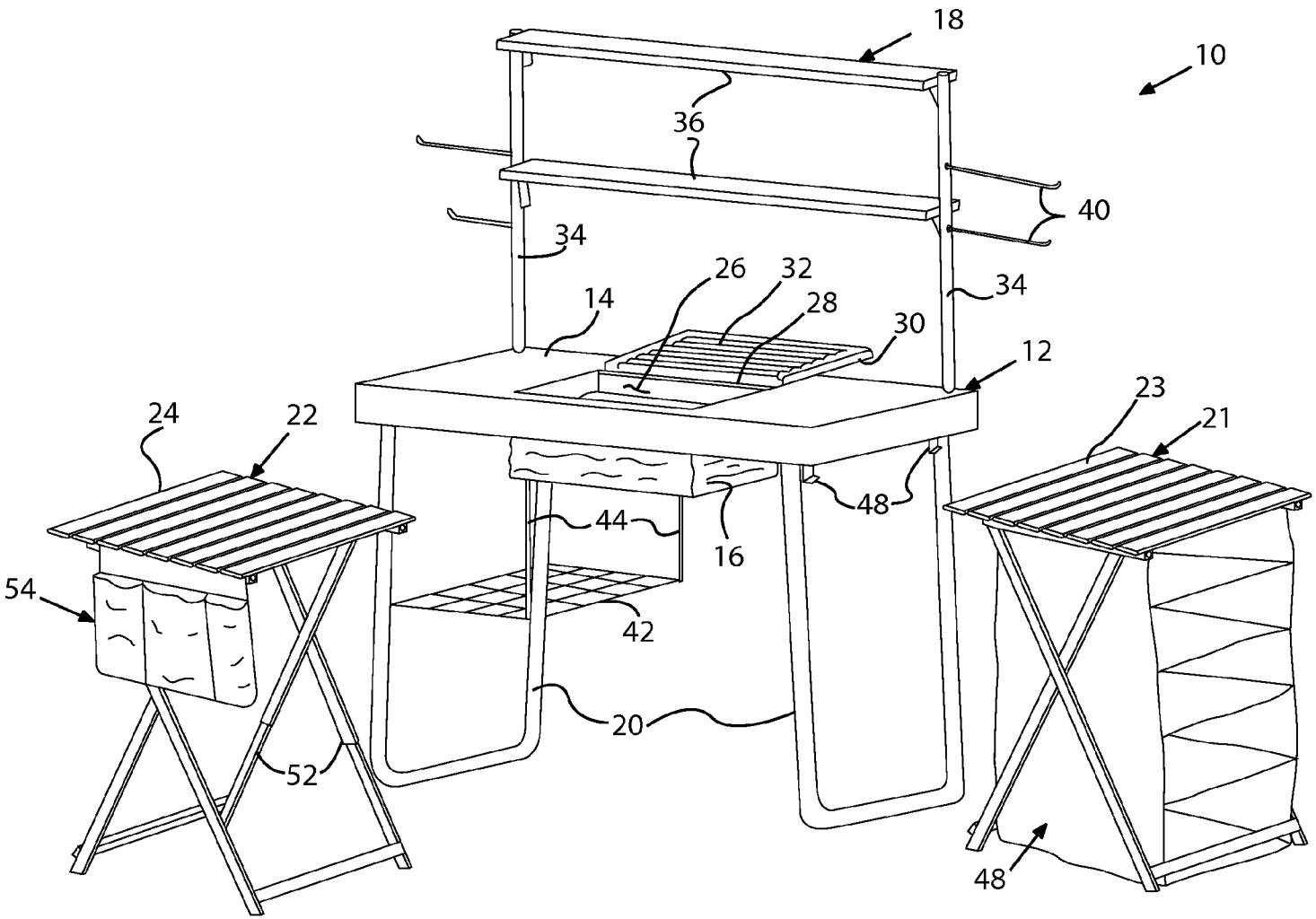
FIG. 1 is a perspective view of an exemplary embodiment of the present invention assembly shown in an open and deployed condition.

Referring to FIG. 1, there is shown an exemplary embodiment of the present invention assembly 10. The assembly 10 includes a primary table 12 having a tabletop 14 and a washbasin 16 set into the tabletop 14. A rack of shelves 18 extends upwardly from the tabletop 14. Storage facilities are disposed under the tabletop 14, as will be later described.

Two secondary tables 21, 22 are also provided. Each of the secondary tables 21, 22 have tabletops 23, 24 and storage elements that are suspended below the tabletops 23, 24.

The primary table 12, washbasin 16, rack of shelves 18, secondary tables 21, 22 and the various storage elements all store together as a single, small portable assembly. In this manner, all of the shown elements can be stored together and carried together as a single unit by a camper. The elements shown in FIG. 1 combine to provide all the elements needed to complete a portable camping kitchen.

The primary table 12 has a flat tabletop 14 that is supported by a plurality of folding legs 20. The manner by which the legs fold and extend is not of great importance and many prior art folding leg configurations can be used. In the center of the tabletop 14 is disposed a large sink opening 26. A flap 30 is connected by a hinge joint 28 to one side of the sink opening 26. The hinge joint 28 on the flap 30 enables the flap 30 to be selectively opened or closed over the sink opening 26. When the flap 30 is closed, the flap 30 sets into the tabletop 14 and closes the sink opening 26. Consequently, the closed flap 30 becomes part of the tabletop 14. When the flap 30 is opened, the hinge joint 28 holds the flap 30 adjacent to the sink opening 26 at a slight inclined angle.

When the flap 30 is opened, the underside of the flap 30 faces upwardly. A drain grate 32 is provided on the underside of the flap 30. The drain grate 32 holds wet objects and enables water dripping from such objects to drop onto the flap 30 and flow down through the sink opening 26.

A collapsible washbasin 16 is supported below the tabletop 14, under the sink opening 26. The collapsible washbasin 16 has flexible walls made of plastic or waterproof treated fabric. Accordingly, the washbasin 16 can hold a volume of water without leaking.

The rack of shelves 18 extends upwardly from the top of the tabletop 14. The rack of shelves 18 is comprised of two vertical poles 34 that have one end set into the structure of the tabletop 14. A plurality of shelves 36 are suspended between the vertical poles 34. The shelves 36 have mounting brackets 38 disposed along their short sides. The mounting brackets 38 engage the vertical poles 34, thereby enabling the shelves 36 to be selectively attached to the vertical poles 34. The shelves 36 are strong and can hold a wide variety of objects, such as canned food, boxed food, spices, soap and the like.

Wire hangers 40 protrude from the vertical poles 34 at different points. The wire hangers 40 are provided to hold washcloths, dish towels, paper towels or a lantern handle. The wire hangers 40 can also pass through the perforated handles of cooking utensils, such as spatulas, spoons and the like. The wire hangers 40 engage holes in the vertical poles 34 and can be folded flush against the vertical poles 34 when not in use.

A wire rack 42 is suspended below the tabletop 14. The wire rack 42 is suspended between two legs 20 of the primary table 12 and two detachable suspension elements 44. The suspension elements 44 join the wire rack 42 to the bottom of the tabletop 14. The wire rack 42 is capable of holding heavy objects, such as water containers and large canned provisions.

Hook brackets 46 extend downwardly from the underside of the tabletop 14. The hook brackets 46 serve a dual purpose. First, the hook brackets 46 can be used to suspend collapsible storage compartments 48. The storage compartments 48 are preferably sewn from fabric and can be folded flat when not in use. When suspended from the hook brackets 46, the storage compartments 48 define separate compartments for holding lightweight camping items such as napkins, cups and the like. The hook brackets 46 are also used when the entire assembly 10 is configured for storage, as will later be described.

The secondary tables 21, 22 each have flat tabletops 23, 24 and foldable legs 52 that are configured in a crisscrossing pattern. The foldable legs 52 may also have a telescoping configuration that allows the legs 52 to be selectively increased and deceased in length.

Storage compartments can also be suspended from below the secondary tables 21, 22. In FIG. 1, one of the secondary tables 21 has a foldable storage compartment 48 configured as parallel hanging shelves. The other secondary table 22 has an alternate storage compartment 54 that is divided into vertical pockets 56. This alternate storage compartment 54 can be used to hold utensils and similar objects. The use of two different types of storage compartments 48, 54 is done to illustrate that the storage compartments 48, 54 can have many different configurations. What is of importance is that flexible, foldable compartments are provided under the various tabletops 23, 24 so that this space can be utilized to store materials.

Figure 2:
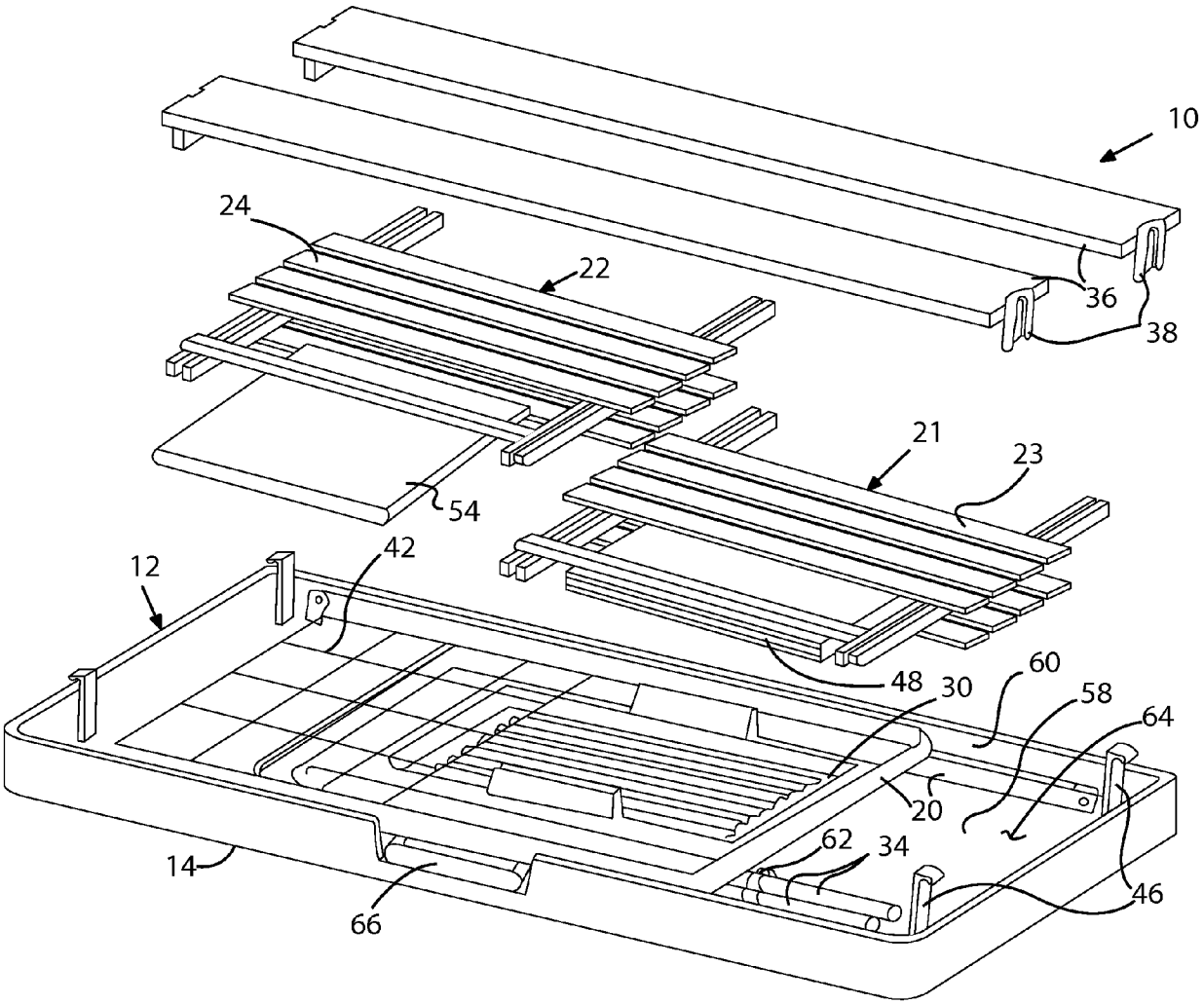
FIG. 2 is a partially exploded perspective view of the assembly of FIG. 1 with the components shown in their folded condition.

Referring to FIG. 2 in conjunction with FIG. 1, it will be understood that the rack of shelves 18 can be dissembled by removing the vertical poles 34 from the tabletop 14 and disconnecting the shelves 36 from the vertical poles 56.

The wire rack 42 under the tabletop 14 of the primary table 12 can be dissembled by disconnecting the suspension elements 44 from the wire rack 42.

Lastly, the various storage compartments 48, 54 are removed from the primary and secondary tables 12, 22 and folded flat.

Once the various components are dissembled, the assembly 10 can be reconfigured for storage.

Referring to FIG. 2, it is seen that the flap 30 on the primary table 12 is closed and the primary table 12 is inverted. This causes the bottom surface 58 of the primary table 12 to face upwardly. The bottom surface 58 of the primary table 12 is surrounded with a peripheral lip 60. The peripheral lip 60 is longer than the tabletop 14 is thick. The bottom surface 58 and the peripheral lip 60 therefore combine to define a pocketed area 64.

Clamps 62 are present on the bottom surface 58 of the tabletop 14 that receive and hold the vertical poles 34 of the rack of shelves 18. Once the vertical poles 34 are in place, the legs 20 of the primary table 12 are folded closed. As the legs 20 of the primary table 12 are folded closed, the wire rack 42 folds and lays against the bottom surface 58 of the tabletop 14.

The secondary tables 21, 22 are folded flat. When the secondary tables 21, 22 are folded flat, the tabletops 23, 24 of the secondary tables 21, 22 divide in half and lay against opposite sides of the legs 52 of the secondary tables 21, 22.

The folded secondary tables 21, 22 fit inside the peripheral lip 60 of the primary tabletop 12. The folded secondary tables 21, 22 lay across the folded legs 20 of the primary table 12, thereby holding the legs 20 of the primary table 12 in their folded configuration. The collapsible storage compartments 48, 54 are folded and placed within the pocketed area 64 within the peripheral lip 60 under the folded secondary tables 21, 22.

The shelves 36 used in the rack of shelves 18 each have mounting brackets 38 at their ends. The mounting brackets 38 enable the shelves to selectively engage the vertical poles 34, when the rack of shelves 18 is assembled. The mounting brackets 38 on the shelves 36 engage the hook brackets 46 that extend from the primary tabletop 14.

Figure 3:
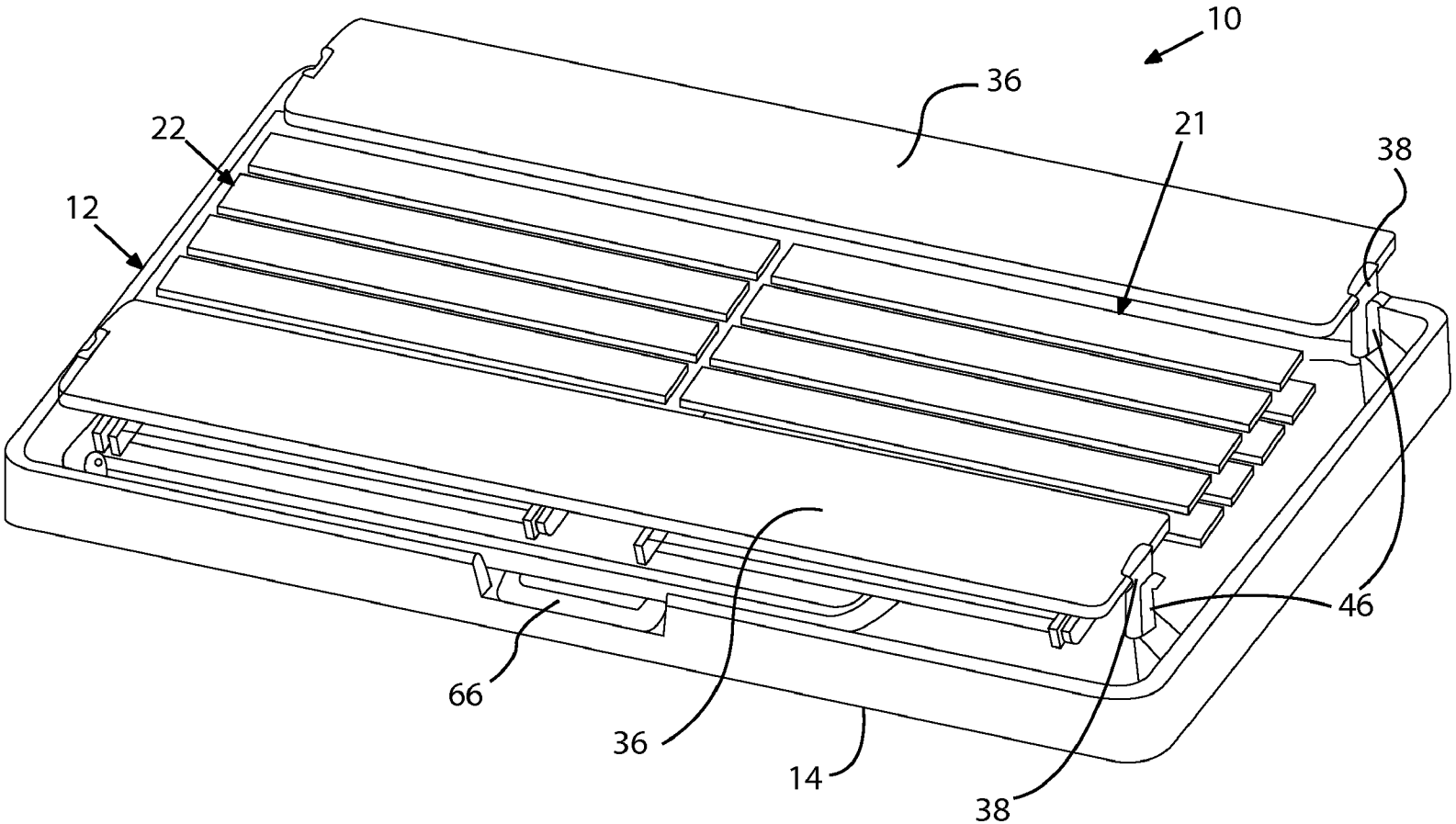
FIG. 3 is a perspective view showing the assembly of FIG. 1 with all the components being attached and stored as a single unit.

Referring to FIG. 3 in conjunction with FIG. 2, it can be seen that as the mounting brackets 38 on the shelves 36 engage the hook brackets 46 on the primary tabletop 14, the shelves 36 are locked in a parallel configuration across the inverted tabletop 14. The shelves 36 pass over the folded legs 52 of the secondary tables 21, 22 on either side of the folded secondary tabletops 23, 24. This locks the secondary tables 21, 22 into place, thereby joining the secondary tables 21, 22 to the primary table 12.

Once the mounting brackets 38 on the shelves 36 engage the hook brackets 46 on the primary tabletop 14, all of the components of the assembly 10 are joined together as a single portable unit.

A handle 66 extends from the side of the primary table 12. The handle 66 enables the stored configuration of the assembly 10 to be readily carried as a single unit.

It will be understood that the embodiment of the present invention that has been described and illustrated is merely exemplary and that a person skilled in the art can make many modifications to the shown embodiment without departing from the intended scope of the invention. For instance, the shape of the primary table and the secondary tables can be changed. The configuration of the storage compartments and storage rack can be changed. All such variations, modifications and alternate embodiments are intended to be included within the scope of the present invention as set forth by the claims.

What is claimed is:

1. A folding table assembly comprising:

a tabletop having a top surface and a bottom surface, wherein a sink opening is defined through said tabletop;

a collapsible washbasin extending below said tabletop around said sink opening;

a flap for covering said sink opening along said top surface, said flap being joined to said tabletop by a hinge joint that enables said flap to be selectively moved between an open position and a closed position, wherein said flap has an underside that faces upwardly when in said open position and closes said sink opening when in said closed position;

a drain rack disposed on said underside of said flap; and legs joined to said tabletop that can be selectively folded between an open, configuration and a folded configuration.

2. The assembly according to claim 1, further including at least one vertical pole that extends upwardly from said top surface of said tabletop.

3. The assembly according to claim 2, further including at least one shelf that is supported by said at least one vertical pole.

4. The assembly according to claim 2, wherein said at least one vertical pole is selectively removable from said top surface of said tabletop and both said at least one vertical pole and said at least one shelf are selectively attachable to said bottom surface of said tabletop.

5. The assembly according to claim 4, further including at least one foldable secondary table that selectively attaches to said bottom surface of said tabletop.

6. The assembly according to claim 5, wherein said at least one foldable secondary table stores between said bottom surface of said tabletop and said at least one shelf, wherein said at least one shelf holds said at least one foldable secondary table in place against said bottom surface of said tabletop.

7. The assembly according to claim 5 further including at least one collapsible storage compartment that is supported by said at least one foldable secondary table.

8. A table set assembly, comprising:

a primary table having a tabletop and foldable legs that enables said primary table to be selectively configured between an open configuration and a folded configuration wherein said tabletop has a top surface and a bottom surface;

a plurality of hook brackets extending from said bottom surface of said tabletop;

a rack of shelves that includes poles and shelves, said rack of shelves being attachable to said top surface of said tabletop in an assembled condition and storable under said tabletop when in a dissembled condition, wherein said plurality of hook brackets engage said shelves and attach said shelves to said bottom surface of said tabletop when stored in said dissembled condition;

at least one secondary table wherein said at least one secondary table is storable between said bottom surface of said tabletop and said shelves, thereby enabling said primary table and said at least one secondary table to be transported together as a single unit.

9. The assembly according to claim 8, wherein a sink opening is defined through said tabletop.

10. The assembly according to claim 9, further including a collapsible washbasin that extends below said tabletop around said sink opening.

11. The table assembly according to claim 9, further including a flap for covering said sink opening along said top surface.

12. The table assembly according to claim 11, wherein said flap is joined to said tabletop by a hinge joint that enables said flap to be selectively moved between an open position and a closed position.

* * * * *